US007220070B2

(12) United States Patent
Narita et al.

(10) Patent No.: US 7,220,070 B2
(45) Date of Patent: May 22, 2007

(54) PRINTER HAVING A CONTINUOUS PAPER HOLDER

(75) Inventors: Hiroshi Narita, Nagano ken (JP); Yoshiki Kinoshita, Suwa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 11/235,984

(22) Filed: Sep. 26, 2005

(65) Prior Publication Data

US 2006/0072955 A1 Apr. 6, 2006

Related U.S. Application Data

(63) Continuation of application No. PCT/JP04/03171, filed on Mar. 11, 2004.

(30) Foreign Application Priority Data

Mar. 27, 2003 (JP) ..... 2003-088805

(51) Int. Cl.
*B41J 11/50* (2006.01)

(52) U.S. Cl. ..... 400/605; 400/56; 400/613

(58) Field of Classification Search ..... 400/605, 400/613, 56

See application file for complete search history.

(56) References Cited

U.S. PATENT DOCUMENTS 6,203,223 B1 3/2001 Nakayama et al.
6,249,301 B1 * 6/2001 Kawamura et al. ..... 347/218

FOREIGN PATENT DOCUMENTS

DE 10016412 A1 10/2001
DE 10056444 C1 10/2001
EP 0 805 043 2 11/1997
JP 59055452 * 3/1984
JP 62-157246 10/1987
JP 04094327 3/1992
JP 4-288260 10/1992
JP 08-080626 3/1996
JP 09-095017 4/1997
JP 11-348364 * 12/1999
JP 2001-113797 4/2001

* cited by examiner

*Primary Examiner*—Daniel J. Colilla
*Assistant Examiner*—Marissa Ferguson-Samreth
(74) *Attorney, Agent, or Firm*—Anderson Kill & Olick, PC

(57) ABSTRACT

A printer having a main printer unit 1 an image recording unit 3 and a base unit 2. The image recording unit 3 includes a carriage 25 having an ink head for discharging ink to paper and a guide shaft 26 for slidably guiding the carriage 25. The base unit 2 is disposed opposite the image recording unit 3 and supports the image recording unit 3. A paper transportation path 5 is located between the image recording unit 3 and base unit 2 for conveying paper in a paper transportation direction under the operation of paper feed means The printer has opposite sides and an opening extending from each opposite side in common alignment with the paper transportation direction for manually inserting paper of substantially any size into said paper transportation path from any side and includes a continuous paper holder which is removably attached to said printer for supplying paper continuously to said paper transportation path and a sheet feeder device (ASF 60) which is removably attached to said main printer unit for supplying a plurality of sheets in sequence to said paper transportation path when said continuous paper holder is not supplying paper.

5 Claims, 10 Drawing Sheets

PRINTER HAVING A CONTINUOUS PAPER HOLDER

CROSS REFERENCE TO RELATED APPLICATIONS

The present application is a continuation of PCT/JP04/03171, filed Mar. 11, 2004 and claims benefit of priority from the prior Japanese Patent Application No. 2003-088805 filed on Mar. 27, 2003.

TECHNICAL FIELD

The present invention relates to a printer which records images on paper.

BACKGROUND OF THE INVENTION

An inkjet printer discharges ink drops using piezoelectric elements, thermal elements, or electrostatic actuators, for example, so that the discharged ink drops form images on paper. A continuous paper holder or automatic sheet feeder (ASF) is also typically attached to the inkjet printer, and the printer conveys roll paper supplied from the continuous paper holder or individual sheets supplied from the automatic sheet feeder in a specific direction and records images on the supplied paper while controlling paper transportation and ink drop discharge.

An inkjet printer of this general type supplies paper from a paper supply opening rendered at the back of the printer case (housing) to the paper transportation path, discharges ink drops from an ink head disposed to a carriage onto the paper conveyed to a specific position in the paper transportation path to record an image, and then discharges the paper from a paper exit rendered at the front of the housing. This inkjet printer is covered in the directions through the thickness of the paper and the width of the paper by the housing and covers, thus protecting the image recording members and other internal components. See, for example, Japanese Unexamined Patent Appl. Pub. H11-348364 (FIG. 1) in which an inkjet printer is taught in which the maximum printable paper size is limited by the size of the paper supply opening. Printing an image on paper that is larger than a specific size, and particularly paper that is wider than a specific size, is therefore not possible.

Furthermore, with the inkjet printer taught in Japanese Unexamined Patent Appl. Pub. H11-348364 the paper on which images are recorded is conveyed from the paper supply opening along the paper transportation path inside the inkjet printer, and even the shape of the conveyable paper is thus also limited. As a result, printing for special purposes, such as conveying note paper that has a relatively complex shape compared with single sheet paper or roll paper and printing images on a particular page of bound notebook paper, is thus not simple.

SUMMARY OF THE INVENTION

In view of the foregoing problem, an object of the present invention is to provide a printer having no limitation on the size or shape of the printable paper.

The printer of the present invention comprises:

a main printer unit having an image recording unit for printing on paper, a base unit which is disposed opposite said image recording unit for supporting said image recording unit;

a paper transportation path disposed between said image recording unit and said base unit; and paper feed means for directing paper along said paper transportation path in a given paper transportation direction, wherein said printer has opposite sides and a common opening extending from each opposite side in relative alignment to the paper transportation direction for manually inserting paper of substantially any size into said paper transportation path from any of the opposite sides of said printer The printer is preferably fixed cantilevered at one end portion of the base unit.

The printer may also comprise:

a continuous paper holder which is removably attached to the main printer unit for supplying paper continuously to the paper transportation path; or a sheet feeder device which is removably attached to the main printer unit for sequentially supplying a plurality of sheets of paper to the paper transportation path when said continuous paper holder is not supplying paper.

The continuous paper holder includes a projection which obstructs inserting paper to the paper transportation path through the opening when the continuous paper holder is installed to the main printer unit.

The continuous paper holder comprises a base unit receiving portion for holding the base unit; and a continuous paper holding portion formed in unison with the base unit receiving portion for holding a supply of paper for said continuous paper holder to continuously supply paper to the paper transportation path.

The continuous paper holding portion holds the continuous paper wound in a roll so that the maximum height of the continuous paper is less than or equal to the height of the paper transportation path.

The sheet feeder device allows inserting paper to the paper transportation path from a direction substantially perpendicular to the paper transportation direction when the sheet feeder device is installed to the main printer unit.

DETAILED DESCRIPTION OF THE PREFERRED EMBODIMENT OF THE INVENTION

An embodiment of an inkjet printer is described below with reference to the accompanying figures as a preferred embodiment of a printer according to the present invention.

An inkjet printer according to this embodiment of the invention has a main printer unit 1 (shown in FIG. 1 to FIG. 5), a continuous paper holder 40 (referred to as a "roll paper holder") (see FIG. 6 to FIG. 8) and a slip supply apparatus 60 (or automatic supply feeder "ASF") (see FIG. 9 and FIG. 10) which are removably attached to the main printer unit 1. The parts of this inkjet printer are described below.

(External Construction of the Main Printer Unit)

Figure 1:
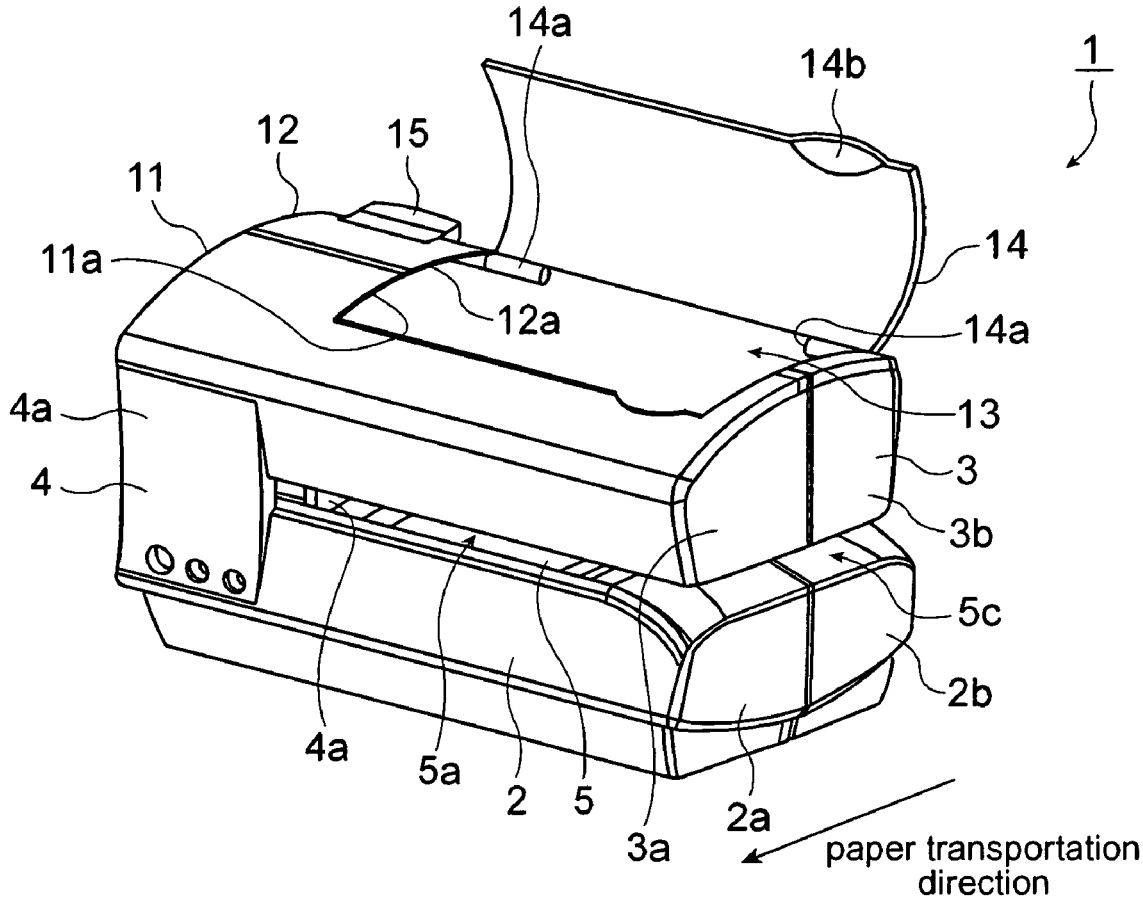
FIG. 1 is an oblique view from the front of the main printer unit of an inkjet printer according to a preferred embodiment of the invention.
Figure 2:
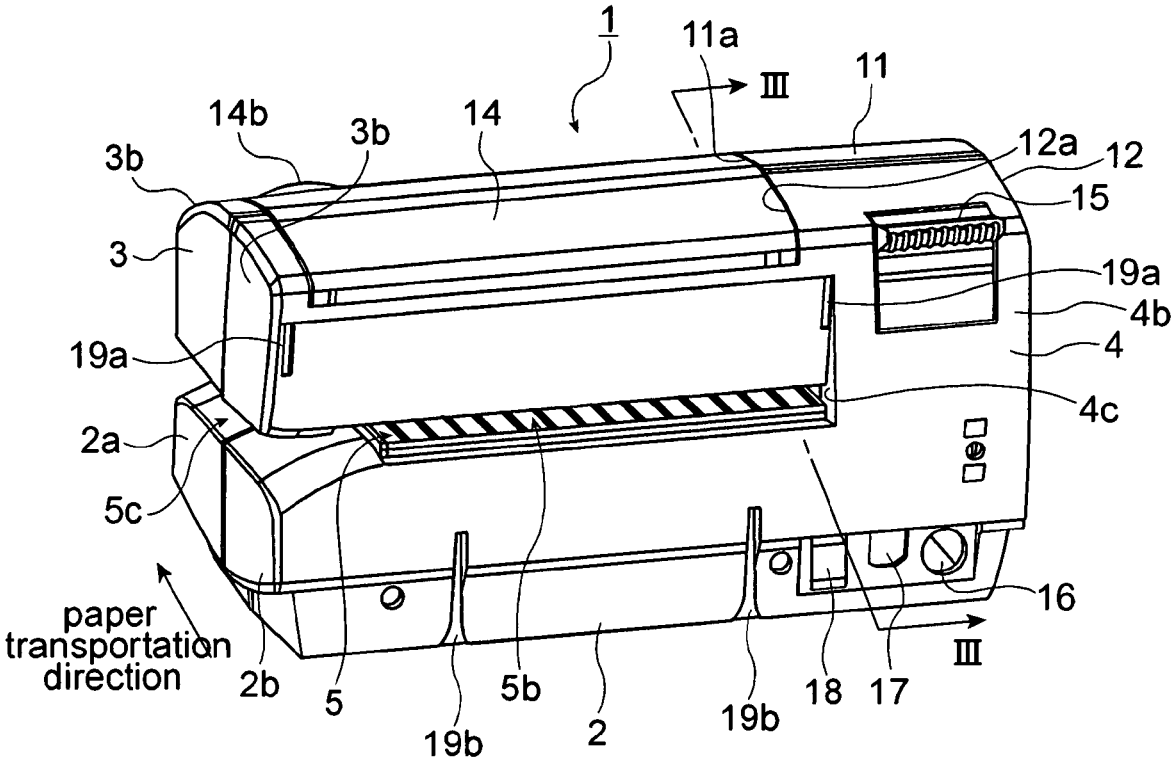
FIG. 2 is an oblique view from the back of the main printer unit.

FIG. 1 is an oblique view from the front of the main printer unit 1 of an inkjet printer according to a preferred embodiment of the invention, and FIG. 2 is an oblique view of the main printer unit 1 as seen from the back.

The general external arrangement of the main printer unit 1 in this embodiment of the invention has an image recording unit 3 supported in a cantilevered manner at one end of the base unit 2 by way of an intervening cantilever unit 4. A paper transportation path 5 for conveying paper from the back side to the front side is rendered between the base unit 2 and image recording unit 3.

The paper transportation path 5 has a front opening 5*a*, a back opening 5*b*, and a contiguous side opening 5*c*. Paper inserted to the paper transportation path 5 is preferably conveyed in the direction from the back opening 5*b* side to the front opening 5*a* side. In a main printer unit 1 according to this embodiment of the invention paper can be inserted to the paper transportation path 5 from any one of these openings, that is, the front opening 5*a*, back opening 5*b*, or side opening 5*c*.

More specifically, paper can be inserted to the paper transportation path in the main printer unit 1 of the present embodiment not only from the back but also from the front and side. More particularly, paper can be manually inserted to the paper transportation path 5 of the main printer unit 1 for printing from a direction substantially perpendicular to the paper transportation direction through the side opening 5*c*. In other words, the main printer unit 1 is arranged so that paper can be inserted through the side opening 5*c* to the paper transportation path 5 from a direction parallel to the paper transportation surface that functions as the paper transportation path 5 between the base unit 2 and image recording unit 3.

The outside walls of the base unit 2, image recording unit 3, and cantilever unit 4 are formed by a front case 11 and a back case 12. The front case 11 is composed of a base unit front case 2*a*, cantilever unit front case 4*a*, and image recording unit front case 3*a* integrally formed in a roughly U-shaped arrangement. The back case 12 is composed of a base unit back case 2*b*, cantilever unit back case 4*b*, and an image recording unit back case 3*b* integrally formed in a roughly U-shaped arrangement. As shown in FIG. 1, an opening 13 composed of mutually opposing U-shaped cut-out 11*a* and cut-out 12*a* is formed in the top of image recording unit front case 3*a* and image recording unit back case 3*b*.

A cover 14 is openably and closably attached via a hinge 14*a* to the edge portion of cut-out 12*a* in the image recording unit back case 3*b*. This cover 14 is attached in order to cover the opening 13 when closed as shown in FIG. 2. By thus covering the opening 13, the cover 14 protects the internal components (not shown in FIG. 1) of the image recording unit 3 from the outside of the main printer unit 1. A protruding tab 14*b* for opening and closing the cover is disposed to the cover 14 on the edge on the opposite side as the side on which the hinge 14*a* is formed. This protruding tab 14*b* is formed so that the user can easily catch the tab 14*b* with a finger to open the cover 14. The user can access the internal components of the image recording unit 3 for maintenance when the cover 14 is open as shown in FIG. 1 so that, for example, an ink cartridge removably installed to the carriage 25 described below can be replaced.

A release lever 15 is further disposed to the cantilever unit back case 4*b*. This release lever 15 is rendered so that the release lever 15 can be pushed down and the platen 21 (see FIG. 3) forming part of the paper transportation path 5 as described below moves up and down in conjunction with other parts attached to the platen 21 when the release lever 15 is operated so that paper can be inserted to the paper transportation path 5. Operation of the release lever 15 is described in further detail below.

A power cable connector 16 to which a cable connected to an external power source is connected to supply power for driving the printer, a data communication terminal 17 to which is connected a USB cable, for example, for data communication between the printer and a personal computer or other host computer, and an ASF drive cable connector 18 to which is connected a power cable for supplying power to the ASF (automatic sheet feeder) 60 are disposed to a portion of the base unit back case 2*b* below the cantilever unit 4.

A cable connection confirmation pin (not shown in the figure) for confirming whether a cable for supplying power to the ASF 60 is connected is also disposed to the ASF drive cable connector 18. The main printer unit 1 determines whether the ASF 60 described below is connected from the cable connection confirmation pin, which is shorted when a cable is connected to the ASF drive cable connector 18. The ASF drive cable connector 18 thus also functions as an ASF connection sensor for determining whether the ASF 60 is installed.

As also shown in FIG. 2, slots 19*a* for attaching the ASF 60 are formed on the back of the image recording unit back case 3*b*. In addition, slots 19*b* for attaching the roll paper holder 40 described below are formed in the back of the base unit back case 2*b*. Attaching the roll paper holder 40 and the ASF unit 60 to the printer is described further below.

(Internal Structure of the Main Printer Unit)

Figure 3:
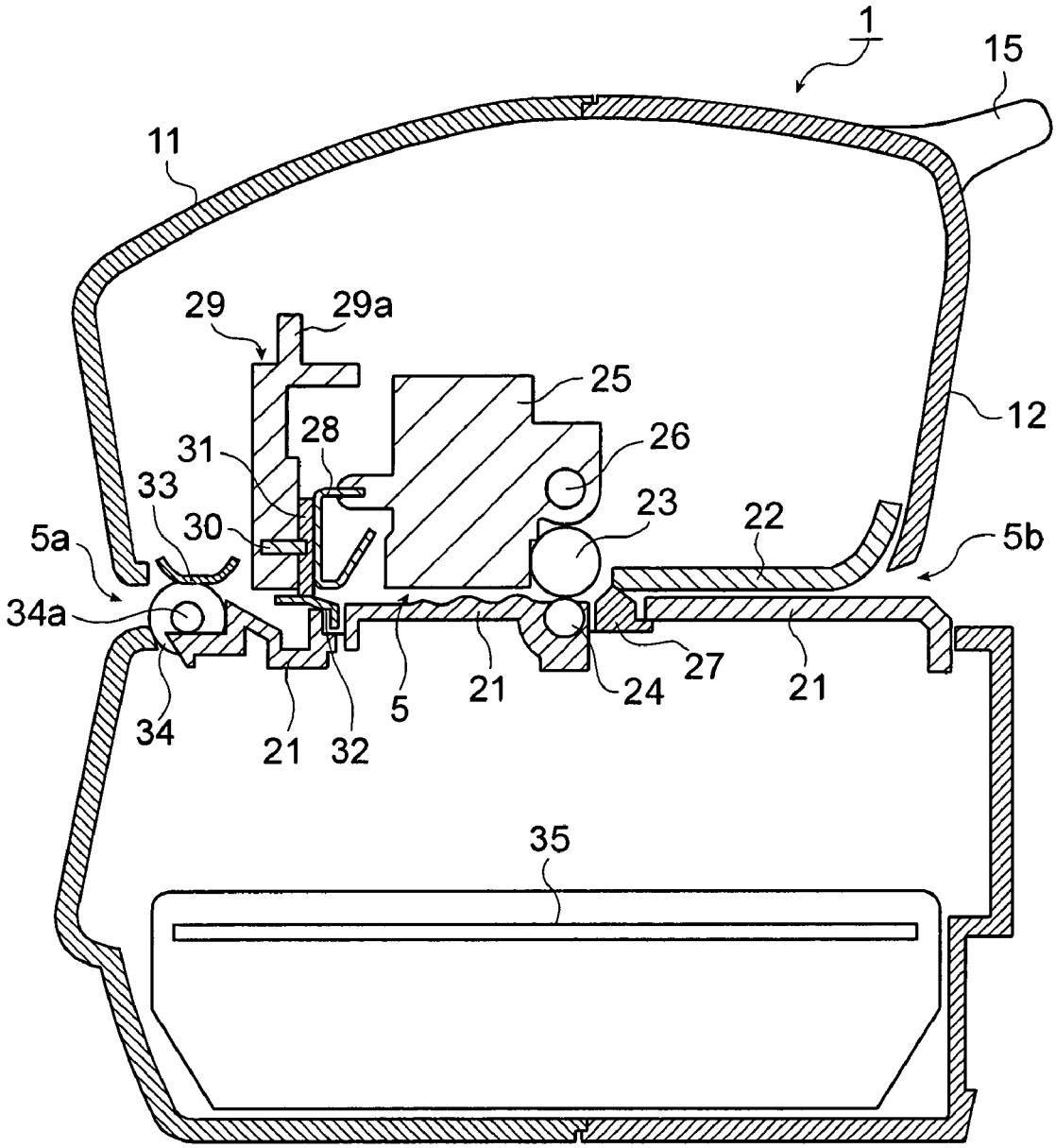
FIG. 3 is a section view through line III—III in FIG. 2.
Figure 4:
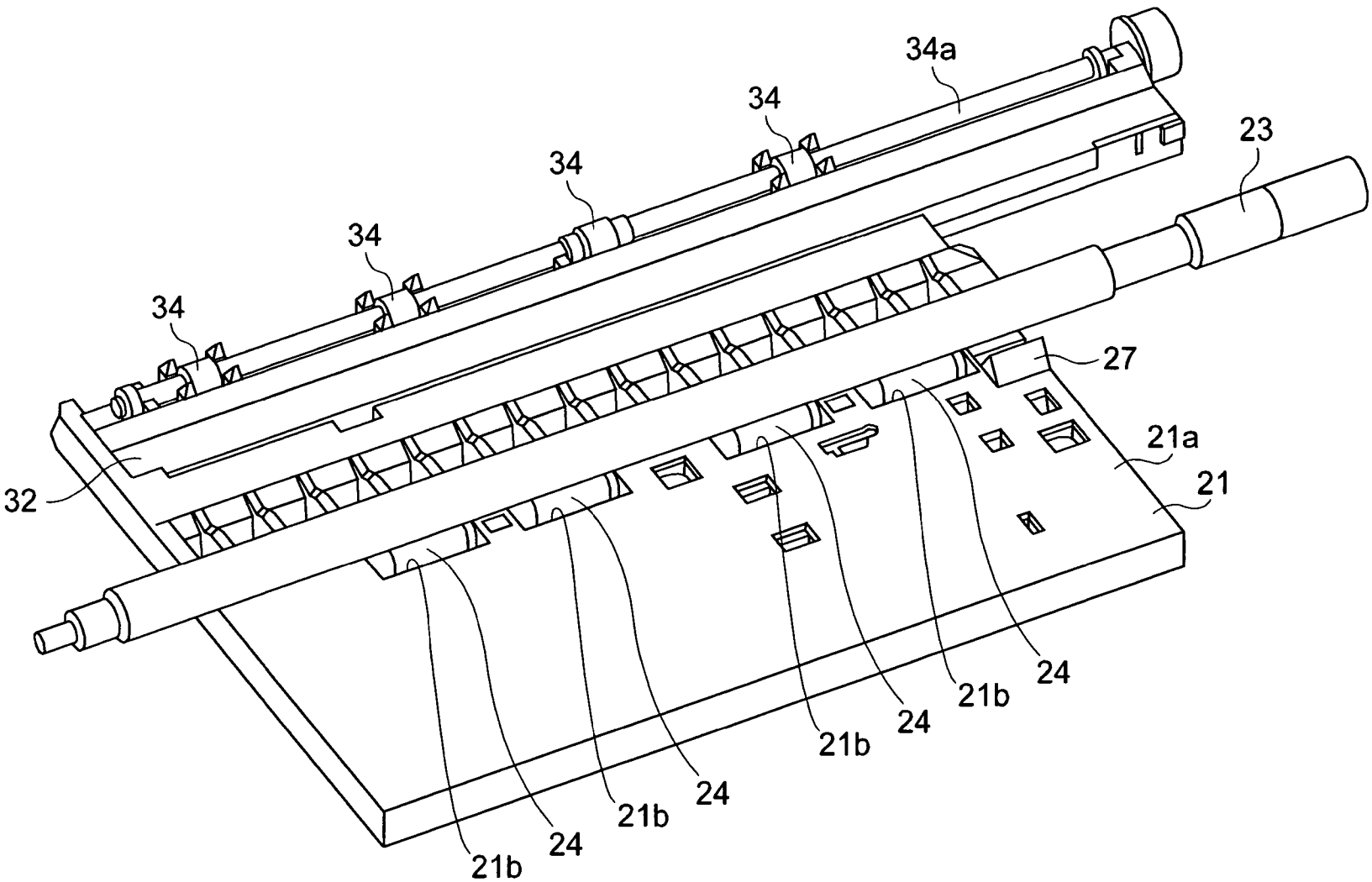
FIG. 4 is an oblique view showing the arrangement in the proximity of the paper transportation path.
Figure 5:
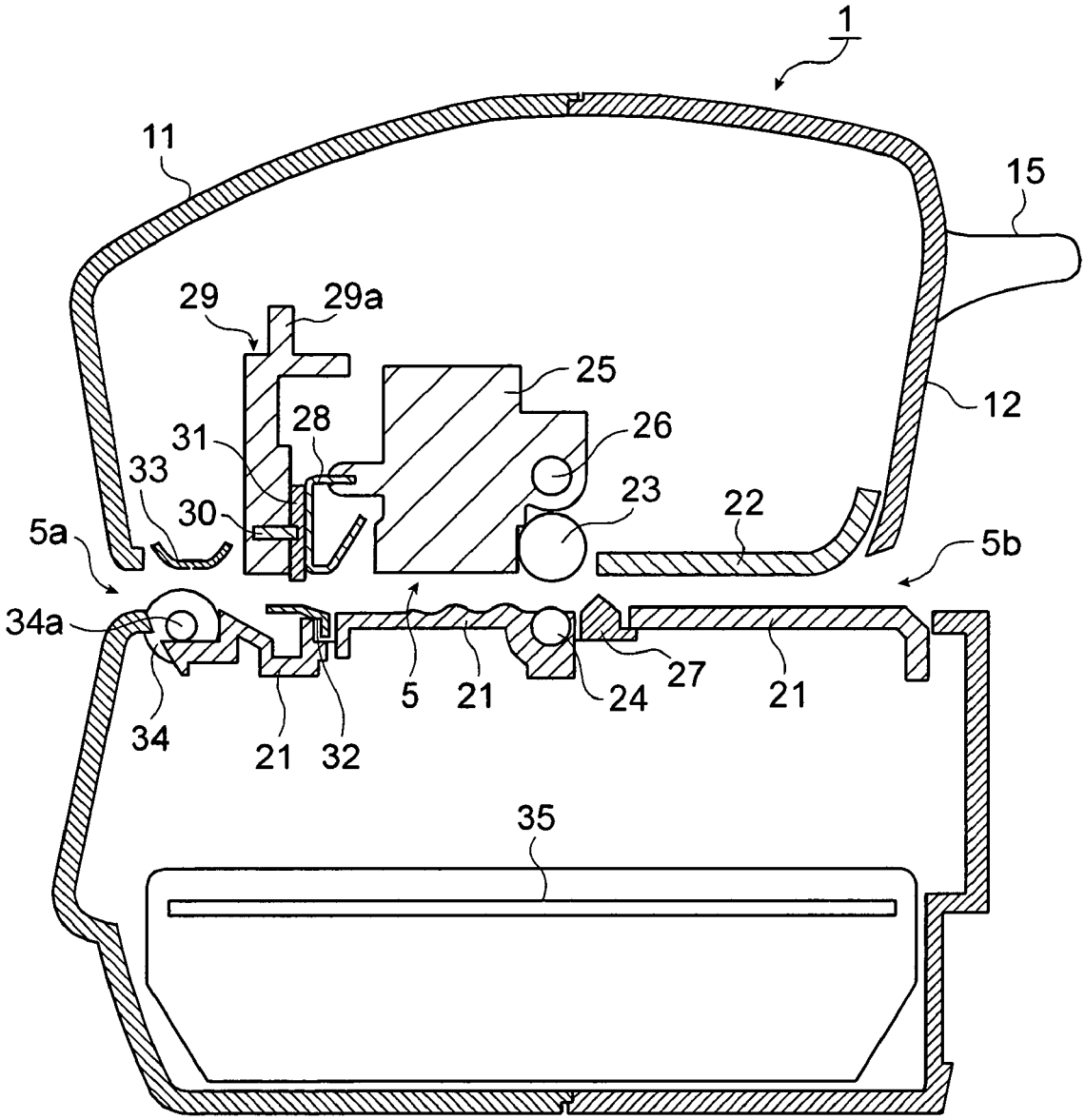
FIG. 5 is a section view showing the paper transportation path when the parts constituting the bottom surface of the paper transportation path are lowered.

FIG. 3 is a section view through line III—III in FIG. 2 showing the major components of the internal structure of the main printer unit 1. FIG. 4 is an oblique view showing the arrangement around the paper transportation path, and FIG. 5 is a section view showing the parts constituting the bottom surface of the paper transportation path in the lowered position.

A platen 21 constitutes the major part of the bottom surface of the paper transportation path 5 from the back opening 5*b* to the front opening 5*a*. The platen 21 is a plate-like member forming the top surface of the base unit 2, and the top surface 21*a* thereof is substantially flat as shown in FIG. 4. Disposed to the top of the paper transportation path 5 opposite the platen 21 in order from the upstream side are a paper guide 22, main paper transportation roller 23, carriage 25, automatic paper cutter 29, and TOF lever 33. A control circuit board 35 is located below the platen 21. These components are further described below as they relate to the platen 21.

The paper guide 22 is disposed opposite the platen 21 on the upstream side of the paper transportation path 5. The paper guide 22 forms a convexly curving surface on the side facing the paper transportation path 5 so that paper supplied from the back opening 5*b* is inserted smoothly to the paper transportation path 5. Paper inserted from the back opening 5*b* is conveyed between the platen 21 and paper guide 22 to the main paper transportation roller 23.

Multiple recessed portions 21*b* are formed at approximately the middle of the platen 21 in the paper transportation direction. A paper feed roller 24 is rotatably disposed in each of these recessed portions 21*b*. The paper feed rollers 24 are located opposite the main paper transportation roller 23 located thereabove, and thus follow rotation of the main paper transportation roller 23, which is driven by a motor not shown. The paper is nipped between the main paper transportation roller 23 and paper feed rollers 24, and can thus be conveyed in the paper transportation direction or the opposite direction.

A BOF lever 27 is disposed to the platen 21 near the main paper transportation roller 23. This BOF lever 27 is a part of the paper trailing-end detector, and is arranged so that conveying paper over the platen pushes the BOF lever 27 down. This depression of the BOF lever 27 is sensed by a BOF sensor not shown which is composed of an optical sensor and linkage mechanism formed integrally to the BOF lever 27, for example. This optical sensor not shown detects a state change in the BOF lever 27 and outputs a signal to the control circuit board 35. As a result, the paper is known to be below the BOF lever 27. This BOF sensor also senses the timing at which the BOF lever 27 returns to the previous state, and outputs a signal to the control circuit board 35. That the paper has moved from above the BOF lever 27 can thus be determined.

The carriage 25 is disposed opposite the platen 21 on the downstream side of the main paper transportation roller 23. The carriage 25 is supported by a guide plate 28 and guide shaft 26 extending lengthwise along the direction (perpendicular to the paper transportation path 5, that is, widthwise to the paper) joining the paper transportation path 5 side 4*c* of the cantilever unit 4 and the side opening 5*c*. The carriage 25 can thus slide freely along the guide shaft 26 and guide plate 28 perpendicularly to the paper transportation path 5.

The carriage 25 carries an inkjet head (not shown in the figure) having a plurality of nozzles for discharging ink to the paper disposed facing the platen 21. Images are recorded on paper positioned on the platen 21 by discharging ink from plural nozzles of the ink head while the carriage 25 travels along the guide shaft 26. An ink cartridge (not shown in the figure) for supplying ink to the ink head is also removably installed to the carriage 25.

An automatic paper cutter 29 is disposed on the downstream side of the carriage 25. The automatic paper cutter 29 is composed of a cutter guide 29*a* which is slidably fixed on the image recording unit 3 side, and a disk-shaped rotating cutter blade 31 rotatably axially supported by a rotating shaft 30 on the cutter guide 29*a* between the cutter guide 29*a* and guide plate 28. The rotating cutter blade 31 is located opposite a stationary cutter blade 32 disposed to the platen 21. The automatic paper cutter 29 cuts roll paper positioned over the stationary cutter blade 32 by pressing and moving the rotating cutter blade 31 against the stationary cutter blade 32 widthwise to the paper in conjunction with the cutter guide 29*a*.

Paper transportation subrollers 34 are located near the front opening 5*a* on the downstream side of the automatic paper cutter 29. The paper transportation subrollers 34 are rotatably axially supported on the platen 21 by means of rotary shaft 34*a*. The paper transportation subrollers 34 are opposite a paper transportation subroller guide not shown, and thus convey paper in the paper transportation direction or the opposite direction with the paper nipped between the paper transportation subrollers 34 and this paper transportation subroller guide. The paper conveyed in the paper transportation direction by the paper transportation subrollers 34 is discharged from the front opening 5*a*.

The TOF lever 33 is disposed to the paper transportation subroller guide not shown. This TOF lever 33 is a part of a paper leading-edge detector, and is disposed so that paper passing below the TOF lever 33 pushes the TOF lever 33 up. This raising of the TOF lever 33 is sensed by a TOF sensor not shown which is composed of an optical sensor and linkage mechanism formed integrally to the TOF lever 33, for example. This optical sensor not shown detects a state change in the TOF lever 33 and outputs a signal to the control circuit board 35. As a result, the paper is known to be above the TOF lever 33. This TOF sensor also senses the timing at which the TOF lever 33 returns to the previous state, and outputs a signal to the control circuit board 35. That the paper has moved from below the TOF lever 33 can thus be determined.

The control circuit board 35 disposed below the platen 21 is populated with a control chip for centrally controlling the operation of other parts of the main printer unit 1, and memory chips for temporarily storing print commands and print data received through the command data communication terminal 17 from an external source. Detection signals from the TOF sensor, BOF sensor, ASF connection sensor, and a roll paper holder connection sensor 38 described below are sent to the control circuit board 35 for determining the position of the paper and whether the ASF 60 and roll paper holder 40 are installed.

When the release lever 15 is pushed down to the open position, the platen 21 and the parts attached to the platen 21 are also displaced downward as shown in FIG. 5. Displacing the platen 21 downward vertically opens the paper transportation path 5 so that slips can be manually inserted or roll paper can be loaded. The platen 21 returns to the position shown in FIG. 3 when the release lever 15 is returned to the original closed position, thus preventing manual insertion of slips and inserting roll paper.

As described above, printing to manually inserted paper is possible using only the main printer unit 1. When printing to manually inserted forms, the user can insert paper to the paper transportation path 5 inside the main printer unit 1 from any of the front opening 5*a*, back opening 5*b*, and side opening 5*c* to print images without worrying about the paper size.

More particularly, when using the main printer unit 1 alone, images can be printed with no concern for the shape of the part of the paper that is not inserted into the paper transportation path 5. This enables inserting only one of multiple pages bound at one edge, such as in a book or notebook, to the paper transportation path 5 so that an image can be printed to just that one page. Specialized printing applications, such as printing an image on only one page or each page in a bound notebook, can thus be easily accomplished.

(Roll Paper Holder)

Figure 6:
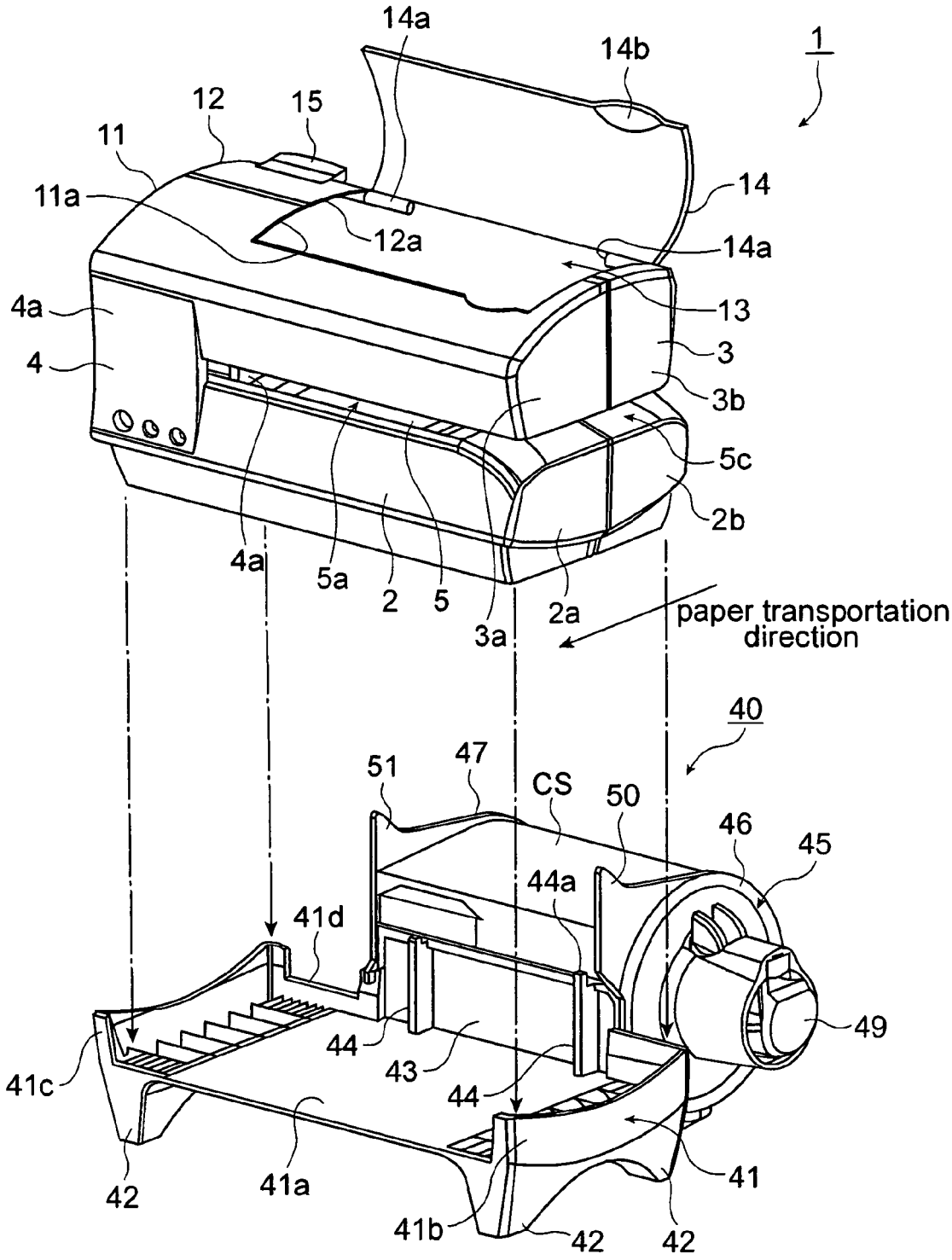
FIG. 6 is an oblique view from the front showing how the roll paper holder is attached to the main printer unit.
Figure 7:
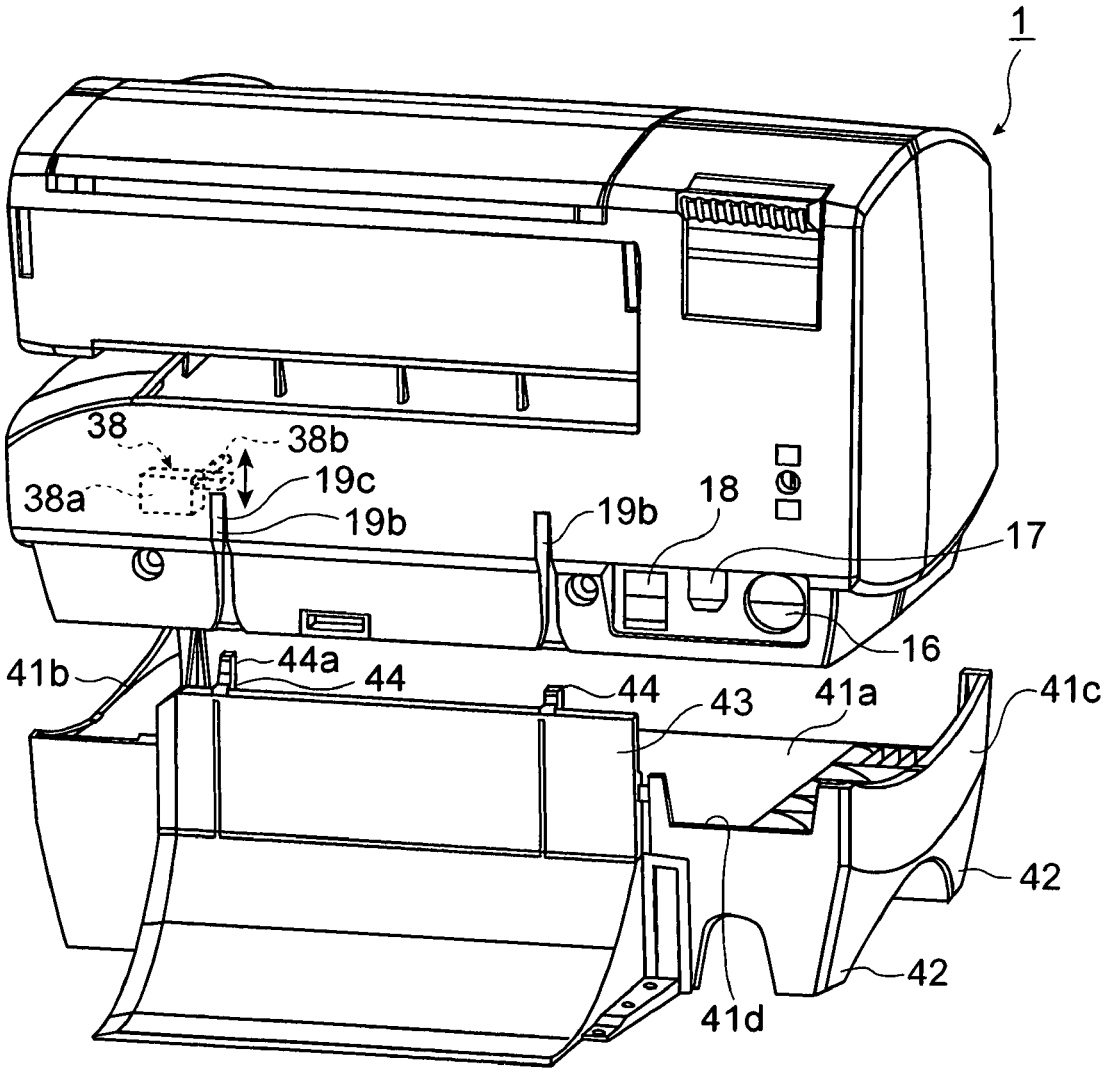
FIG. 7 is an oblique view from the back showing how the roll paper holder is attached to the main printer unit.
Figure 8:
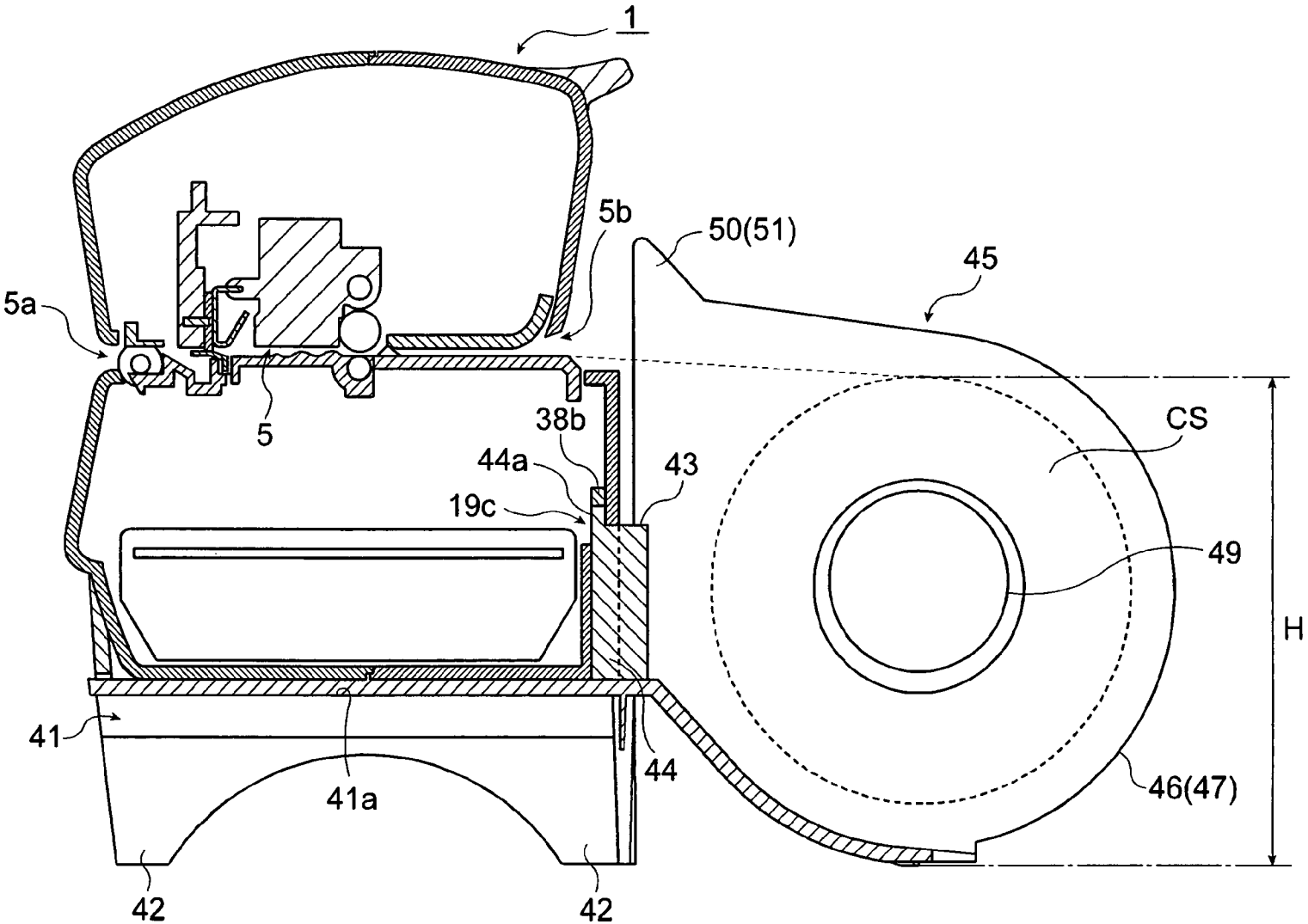
FIG. 8 is a section view showing the roll paper holder attached to the main printer unit.

FIG. 6 is an oblique view showing installing a roll paper holder 40 to the main printer unit 1 as seen from the front, FIG. 7 is an oblique view showing installing a roll paper holder 40 to the main printer unit 1 as seen from the back, and FIG. 8 is a section view showing the roll paper holder 40 installed to the main printer unit 1.

The roll paper holder 40 is configured for installation as a first attachment to the main printer unit 1 in this embodiment of the invention. The roll paper holder 40 and installation thereof are described next below.

The roll paper holder 40 is a part for supplying roll paper CS to the main printer unit 1 as continuous paper. The roll paper holder 40 is composed of main printer unit base 41 and a roll paper holding unit 45 attached in unison with the main printer unit base 41.

The main printer unit base 41 is a base in which the base unit 2 of the main printer unit 1 fits, and is composed of a platform 41*a* which conforms to the shape of the bottom of the main printer unit 1 and is substantially rectangular when seen in plan view, four leg portions 42 formed in unison with the four corners of the platform 41*a*, and side guide walls 41*b*, 41*c* rising vertically from the widthwise end portions of the platform 41*a*. A portion of guide wall 41*b* curves from the widthwise end portion of the platform 41*a*, and another portion of the guide wall 41*b* extends between the front edge and the back edge of the platform 41*a*. The base unit 2 of the main printer unit 1 fits inside these guide walls 41*b*, 41*c* and is thus stationed on the platform 41*a*. The bottom of the main printer unit 1 is thus raised by the main printer unit base 41 and the height of the paper transportation path 5 (the height from the installation surface) is thus higher than when the roll paper holder 40 is not installed.

Notch 41*d* is also formed in a portion of the guide wall 41*b* extending to the back-side edge of the platform 41*a* as shown in FIG. 7 so that the power cable connector 16 and data communication terminal 17 disposed to the main printer unit 1 are not covered by the guide wall 41*b*. A power supply cable and USB cable can thus be connected through this notch 41 to the power cable connector 16 and data communication terminal 17 while the main printer unit 1 is stationed on the main printer unit base 41. Because the ASF 60 described below cannot be installed when the roll paper holder 40 is installed in this embodiment, the ASF drive cable connector 18 is covered by the guide wall 41*b*.

Back guide wall 43 rises from the platform 41*a* at the back edge of the platform 41*a*. Positioning ribs 44 corresponding to the slots 19*b* formed in the main printer unit 1 are disposed to the front of this back guide wall 43 as shown in FIG. 6 and FIG. 7. These positioning ribs 44 fit into the slots 19*b* in the main printer unit 1 and thus position the main printer unit 1 on the platform 41*a*. Note that FIG. 7 is drawn to emphasize the installation parts for the roll paper holder 40, and the roll paper holding unit 45 of the roll paper holder 40 is thus omitted from the figure.

A tab 44*a* is disposed to the vertical top end of one of the positioning ribs 44 (the left positioning rib 44 as seen in FIG. 7). As shown in FIG. 7 and FIG. 8, this tab 44*a* is inserted to the base unit back case 2*b* through an opening 19*c* formed at one lengthwise end of slot 19*b*. A roll paper holder connection sensor 38 is installed at a position corresponding to this opening 19*c* inside the base unit back case 2*b*.

This roll paper holder connection sensor 38 is composed of, for example, a sensor base 38*a* and a detection trigger 38*b* which is attached in order to move circularly to the sensor base 38*a*. When the tab 44*a* of the positioning rib 44 is inserted to opening 19*c*, the tab 44*a* contacts the detection trigger 38*b* and causes the detection trigger 38*b* to swing. The sensor base 38*a* detects this movement of the detection trigger 38*b* and outputs to the control circuit board 35. The controller on the control circuit board 35 thus knows that the roll paper holder 40 was installed.

The roll paper holding unit 45 is attached to the back of the back guide wall 43. The roll paper holding unit 45 is composed of guide members 46 and 47 which guide the widthwise sides of the roll paper CS, and a stationary spindle 49 which is fixed to the guide members 46 and 47 and allows the roll paper CS to turn. As shown in FIG. 8 the stationary spindle 49 supports the roll paper CS by passing through a through-hole formed in the center of the take-up spool, and allows the roll paper to roll around the stationary spindle 49 as the leading end of the roll paper is pulled out.

As also shown in FIG. 8 the roll paper holding unit 45 holds the roll paper CS so that when an unused roll of roll paper CS is loaded, the roll paper holding unit 45 holds the roll paper CS so that the maximum height H of the roll paper CS is substantially equal to or slightly below the height of the paper transportation path.

By thus holding the roll paper CS so that the maximum height H of the roll paper CS is substantially equal to or slightly below the height of the paper transportation path, the roll paper CS pulled out and conveyed through the paper transportation path 5 is not curled in the opposite direction as the curl of the wound roll when the paper enters the paper transportation path 5. It is thus more difficult for problems such as the leading edge of the roll paper CS snagging or jamming inside the paper transportation path 5 inside the main printer unit 1 to occur when the roll paper is inserted, and the roll paper CS can be conveyed smoothly through the paper transportation path 5 when the paper is transported.

This is achieved by means of this arrangement whereby the main printer unit base 41 raises the bottom of the main printer unit 1 and positions the paper transportation path 5 at a greater height from the desk surface so that the stationary spindle 49 can be positioned at a low position even when the diameter of the roll paper CS is large. Conversely, because the height of the stationary spindle 49 can be set low, the maximum height H of the roll paper CS can be held at substantially the same height or slightly lower than the height of the paper transportation path even when the diameter of the roll paper CS is large.

Note that the roll paper CS is loaded in the main printer unit 1 by depressing the release lever 15 so that the paper transportation path 5 is open and then inserting the paper to the paper transportation path 5 from the back opening 5*b*.

Manual insertion prevention tabs 50 and 51 are also formed as part of the guide members 46 and 47. As shown in FIG. 8, these manual insertion prevention tabs 50 and 51 are rendered so that when the main printer unit 1 is stationed in the main printer unit base 41 of the roll paper holder 40 the manual insertion prevention tabs 50 and 51 intersect the plane extending the paper transportation path 5 of the main printer unit 1 in the paper transportation direction. When the roll paper holder 40 is installed to the main printer unit 1, it is generally assumed that roll paper CS will be used for printing. Because roll paper CS will thus be loaded into the paper transportation path 5, manually inserting paper from the side opening 5*c* is undesirable because a paper jam or other problem will result (of course, this is undesirable even if roll paper CS is not located in the paper transportation path 5). These manual insertion prevention tabs 50 and 51 are therefore disposed to the roll paper holder 40 in the present embodiment so that these manual insertion prevention tabs 50 and 51 interfere with inserting paper from the side opening 5*c* and thus prevent incorrect operation by the operator.

As described above, using roll paper holder 40 enables the main printer unit 1 to print images to roll paper CS. More specifically, printing on roll paper CS is enabled by simply attaching the roll paper holder 40 to the main printer unit 1 and loading roll paper CS in the paper transportation path 5.

Furthermore, when the roll paper holder 40 is installed, supplying paper by manual insertion is structurally prohibited as described above.

(ASF (Automatic Sheet Feeder))

Figure 9:
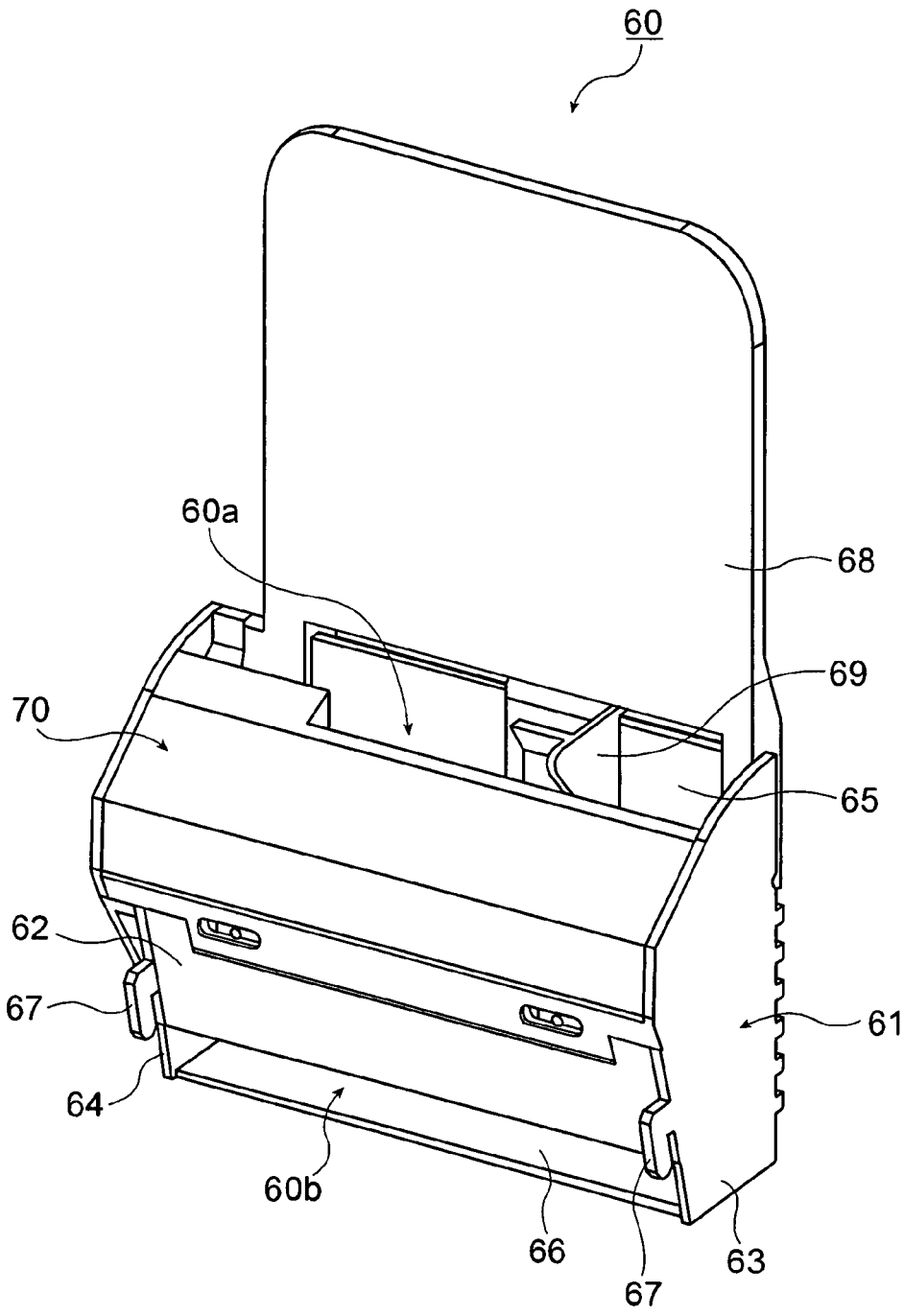
FIG. 9 is an oblique view showing an ASF which can be attached to the main printer unit.
Figure 10:
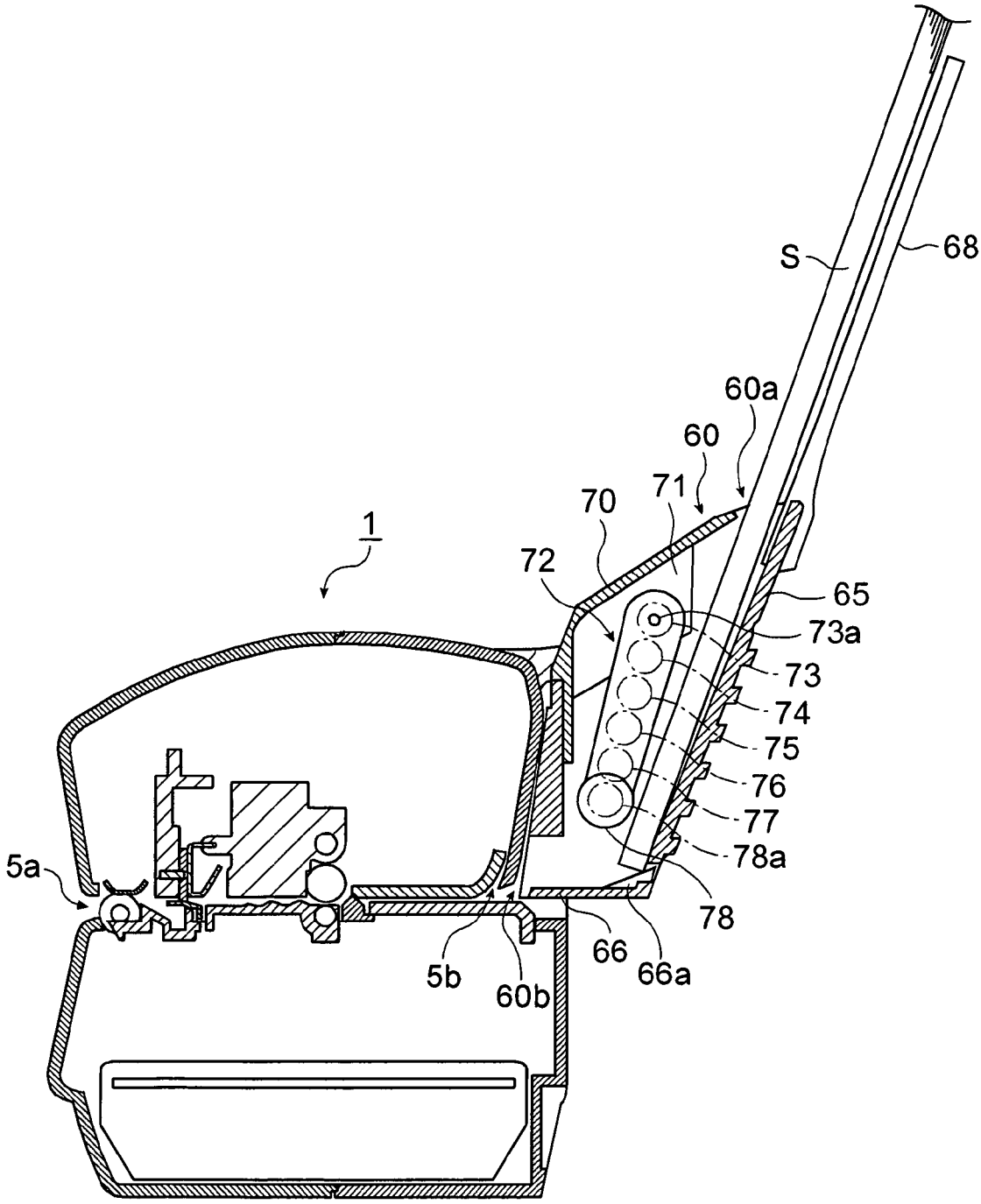
FIG. 10 shows the ASF attached to the main printer unit.

FIG. 9 is an oblique view showing an ASF 60 for installation at the main printer unit 1, and FIG. 10 is a section view showing the ASF 60 installed at the main printer unit 1.

A main printer unit 1 according to this embodiment of the invention is constructed so that an ASF 60 can be removably attached as a second attachment. The ASF 60 and installation thereof are described below.

The ASF 60 is a sheet feeding device that holds a plurality of slips of a particular size and supplies them one sheet at a time into the main printer unit 1. The ASF 60 is primarily composed of a bottom case 61 and a top cover 70. These parts are further described below.

The bottom case 61 is an integrally molded plastic box-like member having a front cover 62 and mutually opposing back cover 65 formed in unison with intervening side covers 63, 64, and a bottom cover 66 rendered on the bottom formed in unison with the side covers 63, 64 and back cover 65. An opening 60*a* is rendered at the top of the bottom case 61 between the front cover 62, side covers 63, 64, and back cover 65. The top cover 70 is inserted from the opening 60*a* and fit to the bottom case 61 such that a portion of the opening 60*a* is covered. The uncovered portion of the opening 60*a* is the paper insertion opening from which a plurality of slips S are inserted at an angle.

A flat paper guide 68 which supports the part of the slips S located above the back cover 65 is attached to the top end of the back cover 65. A paper size limiter 69 which limits the maximum size of slip paper that can be inserted from the opening 60*a* is also disposed at the top end of the back cover 65. This paper size limiter 69 can slide along the top end of the back cover 65 and the position of the paper size limiter 69 can thus be appropriately adjusted to limit the paper size. By setting the width between the paper size limiter 69 and the side cover 61 to substantially the same as the width of the paper that is to be inserted, the paper can be guided by the side cover 61 and paper size limiter 69 and inserted without tipping sideways.

A slope 66*a* is disposed on top of the bottom cover 66 of the bottom case 61 so that the surface of the slope 66*a* is inclined towards the bottom cover 66 as shown in FIG. 10. Inserted slips are thus held by the back cover 65 and paper holding plate 68 in a stack in contact the slope 66*a* or bottom cover 66.

Another opening 60*b* is rendered at the bottom of the bottom case 61 between the front cover 62, side covers 63, 64, and bottom cover 66. This opening 60*b* forms a slip discharge opening from which slips inserted from the opening 60*a*, which is the slip insertion opening, exit.

As shown in FIG. 9, L-shaped hooks 67 are disposed on the front edges of the side covers 63, 64. These hooks 67 are rendered to match the slots 19*b* provided in the image recording unit back case 3*b* as shown in FIG. 2, and the ASF 60 is attached to the main printer unit 1 by engaging these hooks 67 in the slots 19*b*. FIG. 10 shows the ASF 60 installed to the main printer unit 1.

A mounting rib 71 is formed in unison with the top cover 70 on the inside of the top cover 70 (the side facing the back cover 65), and a paper feed roller unit 72 is attached to this mounting rib 71. This paper feed roller unit 72 has a gear 73 connected to a drive shaft 73*a* which is driven by a motor and cable not shown connected to the ASF drive cable connector 18, gear 74 meshing with the gear 73, gear 75 meshing with the gear 74, gear 76 meshing with the gear 75, gear 77 meshing with the gear 76, and a supply roller 78 with a gear 78*a* meshing with the gear 77.

When the drive shaft 73*a* of gear 73 is driven forward or in reverse, the paper feed roller unit 72 moves circularly closer to the slips or away from the slips, and is held either in a position with the supply roller 78 in contact with the paper or in a position with the supply roller 78 separated from the paper. When the drive shaft 73*a* rotates with the supply roller 78 touching the paper, gear 73 turns, the torque of gear 73 is transferred through the gears 74, 75, 76, 77 to gear 78*a*, and the supply roller 78 disposed coaxially to gear 78*a* turns.

Rotationally driving the drive shaft 73*a* of the paper feed roller unit 72 to supply a slip to the main printer unit 1 causes the paper feed roller unit 72 to move circularly to the slips S and causes the supply roller 78 to contact the surface of the topmost slips S. Further rotationally driving the drive shaft 73*a* causes the supply roller 78 to rotate in the forward paper transportation direction (clockwise as seen in FIG. 10), feeds the topmost slip S on the stack of plural slips S at a constant speed through the opening 60*b*, and thus supplies the slip through the back opening 5*b* of the main printer unit 1 into the paper transportation path 5. The main printer unit 1 then records an image on the supplied paper and discharges the paper from the front opening 5*a*. If a next page is to be printed, paper is again fed from the ASF 60 into the paper transportation path 5 and an image is printed.

As shown in FIG. 10, when the ASF 60 is installed to the main printer unit 1, the bottom cover 66 is positioned near an extension of the paper transportation path 5. Because the back opening 5*b* is not closed by the ASF 60 when thus installed, paper can be manually supplied from the side opening 5*c* to the paper transportation path when the ASF 60 is installed.

As will be easily understood by comparison with FIG. 8, if the user attempts to install the ASF 60 to the main printer unit 1 while the roll paper holder 40 is installed to the main printer unit 1, the manual insertion prevention tabs 50 and 51 of the roll paper holder 40 will contact the bottom cover 66 of the ASF 60 and thus obstruct installing the ASF 60. As a result, the ASF 60 cannot be installed to the main printer unit 1 if the roll paper holder 40 is also installed.

Likewise, if the user attempts to install the roll paper holder 40 to the main printer unit 1 while the ASF 60 is installed, the manual insertion prevention tabs 50 and 51 of the roll paper holder 40 will contact the bottom cover 66 of the ASF 60 and thus obstruct installing the roll paper holder 40. The roll paper holder 40 thus cannot be installed to the main printer unit 1 if the ASF 60 is installed. The arrangement of an inkjet printer according to this embodiment of the invention thus prohibits installing both the ASF 60 and roll paper holder 40 to the main printer unit 1 at the same time.

Installing the ASF 60 to the main printer unit 1 enables continuously supplying slips into the paper transportation path and enables printing images on the conveyed slips. Manual paper supply is also possible when the ASF 60 is installed.

An inkjet printer according to this embodiment of the invention as described above has a main printer unit 1 which has a image recording unit 3, which has a carriage 25 on which an ink head for discharging ink to paper and a guide shaft 26 for slidably guiding the carriage 25, and a base unit 2, which is disposed opposite the image recording unit 3 and supports the image recording unit 3. A paper transportation path 5 for conveying paper in the paper transportation direction is rendered between the image recording unit 3 and base unit 2. A side opening 5*c* enabling inserting paper to the paper transportation path 5 from a direction substantially perpendicular to the paper transportation direction is also rendered between the image recording unit 3 and base unit 2. More specifically, the side opening 5*c* is provided as by securing the image recording unit 3 cantilevered from one end of the base unit 2 on an intervening cantilever unit 4.

An inkjet printer according to this embodiment of the invention thus easily enables manually supplying paper through the side opening 5*c* into the paper transportation path 5. Furthermore, because paper can be supplied from the side (a direction substantially perpendicular to the paper transportation path), there is no limit to the size of paper and paper can be manually supplied to the paper transportation path 5 regardless of the shape of the paper. It is therefore possible to supply only one page of an already bound volume such as a book or notebook into the paper transportation path 5, and special printing applications such as printing images on individual pages of a bound volume are possible.

An inkjet printer according to this embodiment of the invention also has a roll paper holder 40, which is removably attached to the main printer unit 1 for supplying roll paper CS (continuous paper) as the print medium to the paper transportation path 5, and an ASF 60, which is removably attached to the main printer unit 1 for continuously supplying slips S as the print medium to the paper transportation path 5.

Because the roll paper holder 40 and ASF 60 can thus be installed to and removed from the main printer unit 1, the arrangement of the inkjet printer can be changed according to the printing application to enable printing to manually fed paper, slip printing, and roll paper printing.

Furthermore, in an inkjet printer according to this embodiment of the invention the roll paper holder 40 has manual insertion prevention tabs 50 and 51 which interfere with manual insertion of paper to the paper transportation path from a direction perpendicular to the paper transportation direction when the roll paper holder 40 is installed to the main printer unit 1.

Therefore, because manually loading paper is not possible when the roll paper holder 40 is installed to the main printer unit 1, unreasonable operations such as manually inserting paper to the paper transportation path 5 when roll paper is already in the paper transportation path 5 are prohibited, and problems such as improper operation of the printer and printer breakdowns are prevented.

The roll paper holder 40 of an inkjet printer according to this embodiment of the invention has a main printer unit base 41 for holding the base unit 2, and a roll paper holding unit 45 formed in unison with the main printer unit base 41 for holding roll paper CS for supply to the paper transportation path 5. More specifically, the bottom of the main printer unit 1 is held in an elevated position by the main printer unit base 41. Therefore, even when the diameter of the roll paper CS is large, the leading end of the roll paper CS can be easily supplied into the paper transportation path 5.

Furthermore, the roll paper holding unit 45 in an inkjet printer according to this embodiment of the invention holds the roll paper CS wound in a roll so that the maximum height H of the roll paper CS is at or below the elevation of the paper transportation path 5.

Therefore, the roll paper CS pulled off the roll and conveyed into the paper transportation path 5 is not curled in the opposite direction as the direction of the curl imparted by the roll winding. The main printer unit 1 can thus smoothly convey the roll paper CS into the paper transportation path 5.

Furthermore, an inkjet printer according to this embodiment of the invention allows inserting paper to the paper transportation path from a direction substantially perpendicular to the paper transportation direction when the ASF 60 is installed to the main printer unit 1.

Paper can thus be manually supplied and manually inserted paper can be printed even when the ASF 60 is installed.

Yet further, the manual insertion prevention tabs 50 and 51 obstruct simultaneously installing both the roll paper holder 40 and ASF 60 to an inkjet printer according to this embodiment of the invention.

Problems such as a slip being supplied from the ASF 60 when roll paper CS is loaded in the paper transportation path 5 are thus prevented, and problems caused by improper operation are prevented.

The roll paper holder 40 is attached to the base unit 2 of the main printer unit 1 and the ASF 60 is attached to the image recording unit of the main printer unit 1 in an inkjet printer according to this embodiment of the invention, but the invention shall not be so limited and could be arranged so that the roll paper holder 40 is attached to the image recording unit 3 using slots 19*a*, for example.

Furthermore, the manual insertion prevention tab 50 could be disposed projecting in front of the side opening 5*c* in order to obtrude the side opening 5*c*. The guide wall 41*b* could also be shaped so that it extends and obtrudes the side opening 5*c*. These variations structurally prohibit supplying paper manually.

The present invention has been described using an inkjet printer by way of example above, but a printer according to the present invention shall not be limited to an inkjet printer and the present invention can be applied to other types of printers, including thermal and dot impact printers.

INDUSTRIAL APPLICABILITY

A printer according to the present invention as described above has a main printer unit composed of an image recording unit for printing on paper and a base unit which supports the image recording unit. A paper transportation path is provided between the image recording unit and base unit for conveying paper in a paper transportation direction under the control of paper feed means, with the printer having a side opening for inserting paper to the paper transportation path.

A printer according to the present invention thus permits paper to be easily manually inserted into the paper transportation path from a common opening extending from each side of the printer. Furthermore, because paper can be supplied from any side (preferably perpendicularly to the paper transportation direction), there is no limit to the size of paper and paper can be manually supplied to the paper transportation path regardless of the shape of the paper. It is therefore possible to supply only one page of an already bound volume such as a book or notebook into the paper transportation path, and special printing applications such as printing images on individual pages of a bound volume are possible.

What is claimed is:

1. A printer comprising:

a main printer unit having an image recording unit for printing on paper, a base unit which is disposed opposite said image recording unit for supporting said image recording unit;

a paper transportation path disposed between said image recording unit and said base unit;

wherein said printer has opposite sides and a common opening extending from each opposite side thereof in alignment relative to the paper transportation direction for manually inserting paper of substantially any size into said paper transportation path from any of the opposite sides of said printer a continuous paper holder which is removably attached to said main printer unit for supplying paper continuously to said paper transportation path; or a sheet feeder device which is removably attached to said main printer unit for supplying a plurality of sheets in sequence to said paper transportation path, wherein said continuous paper holder has a projection, so that said projection obstructs simultaneous installation of said continuous paper holder and said sheet feeder device.

2. The printer described in claim 1, wherein said image recording unit is fixed cantilevered at one end portion of said base unit.

3. The printer described in claim 1, wherein said projection obstructs inserting paper manually into said printer through said opening when said continuous paper holder is installed to said main printer unit.

4. The printer described in claim 1, wherein said continuous paper holder comprises a base unit receiving portion for holding said base unit;

and a continuous paper holding portion formed in unison with said base unit receiving portion for holding a supply of paper for said continuous paper holder.

5. The printer described in claim 3, wherein said continuous paper holding portion holds said supply of paper wound in a roll so that the maximum height of said paper is less than or equal to the height of said paper transportation path.

* * * * *